US008443567B2

(12) United States Patent
Swenson et al.

(10) Patent No.: US 8,443,567 B2
(45) Date of Patent: May 21, 2013

(54) SPACER FOR WELDED WIRE REINFORCEMENT IN CONCRETE STRUCTURES

(76) Inventors: David G. Swenson, Mahwah, NJ (US); Roger J. Patterson, Langhorne, PA (US)

( * ) Notice: Subject to any disclaimer, the term of this patent is extended or adjusted under 35 U.S.C. 154(b) by 158 days.

(21) Appl. No.: 12/924,060

(22) Filed: Sep. 20, 2010

(65) Prior Publication Data

US 2011/0067344 A1 Mar. 24, 2011

Related U.S. Application Data

(60) Provisional application No. 61/277,139, filed on Sep. 21, 2009.

(51) Int. Cl.
*E04C 5/16* (2006.01)

(52) U.S. Cl.
USPC ..... 52/677; 52/636; 52/649.7; 52/649.8; 52/685; 52/686; 404/135; 404/136

(58) Field of Classification Search
USPC ..... 52/636, 649.7, 649.8, 665, 677, 685, 52/686; 404/135, 136
See application file for complete search history.

(56) References Cited

U.S. PATENT DOCUMENTS

| | | | | |
|---|---|---|---|---|
| 4,060,954 | A * | 12/1977 | Liuzza | 52/677 |
| 4,835,933 | A * | 6/1989 | Yung | 52/685 |
| 5,893,252 | A * | 4/1999 | Hardy et al. | 52/685 |
| 6,112,494 | A * | 9/2000 | Hardy et al. | 52/685 |
| 6,276,108 | B1 * | 8/2001 | Padrun | 52/684 |
| 6,925,771 | B2 * | 8/2005 | Lee et al. | 52/685 |
| 6,962,029 | B2 * | 11/2005 | Lowery et al. | 52/682 |
| 7,458,192 | B2 * | 12/2008 | Lowery | 52/682 |
| 7,461,491 | B1 * | 12/2008 | Sorkin | 52/685 |
| 7,506,482 | B2 * | 3/2009 | Sorkin | 52/685 |
| 2005/0210816 | A1 * | 9/2005 | Kelly et al. | 52/677 |
| 2005/0233838 | A1 * | 10/2005 | Kahl | 473/387 |
| 2008/0028718 | A1 * | 2/2008 | Erickson et al. | 52/687 |
| 2011/0214381 | A1 * | 9/2011 | Alfonso | 52/685 |

FOREIGN PATENT DOCUMENTS

| | | | |
|---|---|---|---|
| DE | 3200912 | A1 * | 7/1983 |
| GB | 2072297 | A * | 9/1981 |

* cited by examiner

*Primary Examiner* — Jeanette E Chapman
*Assistant Examiner* — James Buckle, Jr.
(74) *Attorney, Agent, or Firm* — Adams & Wilks

(57) ABSTRACT

A spacer is provided for attachment to a pair of intersecting reinforcement wires to space them from a form. The spacer has a base member having a generally planar shape and two opposite sides, one of the sides having two continuous grooves that extend completely across the base member and that intersect one another for receiving therein a pair of intersecting reinforcement wires, and the other of the sides having a projection that projects outwardly therefrom a preselected distance to space the intersecting reinforcement wires a specified distance from a form. A cover member covers the one side of the base member. The cover member has fastening portions that coact with complementary fastening portions on the base member to fasten the cover member to the base member with the intersecting reinforcement wires sandwiched therebetween to thereby attach the spacer to the intersecting reinforcement wires.

22 Claims, 13 Drawing Sheets

SPACER FOR WELDED WIRE REINFORCEMENT IN CONCRETE STRUCTURES

RELATED APPLICATION

This application claims the benefit of U.S. Provisional Application No. 61/277,139 filed Sep. 21, 2009.

BACKGROUND OF THE INVENTION

1. Field of the Invention

The present invention relates to a non-ferrous spacer for welded wire reinforcement in concrete that attaches at any one perpendicular welded wire intersection of any wire diameter and properly positions the welded wire reinforcement or helical (spiral) reinforcement cage in the body of the form by spacing the reinforcement a specified distance from the outside and/or inside form and/or from other welded wire reinforcements or reinforcement cages.

2. Description of the Related Art

In the manufacture of reinforced concrete structures, specifically reinforced concrete pipe, slabs, walls, and other reinforced concrete products, it is important that the welded wire reinforcement or helical (spiral) reinforcement cage, both made from steel wire with perpendicular welded intersections, is properly positioned within the body of the form prior to the introduction of concrete. Improper positioning of the steel reinforcement will reduce the structural integrity of the reinforced concrete product and may lead to structural failure when placed under a load.

Prior art spacers are known that are manufactured from metal wire and attach at or adjacent to a perpendicular welded wire intersection. Examples of such spacers are disclosed in U.S. Pat. Nos. 3,722,164 to Schmidgall, 4,452,026 to Tolliver, 4,920,724 to Leach et al. and 4,939,883 to Swenson. Within the past decade some United States federal and state agencies have issued specifications that do not allow metal to come in contact with the inside or outside concrete forms. Their belief is that the portion of the metal spacer that touches the inside or outside form is exposed to the atmosphere and will gradually oxidize. As the metal spacer oxidizes, it creates a void which then provides a conduit for moisture to eventually reach the welded wire reinforcement. The welded wire reinforcement will then begin to oxidize and, over time, will result in structural failure of the reinforced concrete product.

There are also known prior art spacers that are manufactured from non-ferrous material. U.S. Pat. Nos. 5,347,787 and 6,385,938 to Gavin and 7,451,579 to Azarin disclose variations of a plastic molded wheel-type spacer that is designed primarily for reinforcement rods or bars (also referred to as rebar). U.S. Pat. Nos. 6,758,021 and 6,910,309 to Trangsrud disclose variations of the same plastic molded clip-on type pyramid spacer that consists of two intersecting triangular planes that come to a point. The pyramid spacer also has two clips at the end of the base to attach to welded wire reinforcement at a perpendicular welded intersection. This pyramid-type spacer has three disadvantages that impair its usefulness:

(1) In many cases the clip-on connector does not compensate for the various wire diameters resulting in the pyramid spacer rocking back and forth at the welded intersection. When the concrete is introduced into the form, this rocking motion can cause a void from the outside and/or inside form which will require additional labor to patch the void after the concrete cures.

(2) The clip-on connectors allow the pyramid spacer to twist or turn at the welded intersection. This twisting or turning allows an inconsistent spacing distance between the welded intersection and the form. It is imperative to have a spacer that will remain aligned to the welded intersection to maintain the reinforcement at a consistent distance from the form.

(3) In severe cases such as cage twist caused by the equipment during the manufacturing process, the clip-on connection can fail by twisting off which would result in the pyramid spacer disengaging from the welded intersection resulting in a reinforcement cage moving from its proper position and negatively affecting the structural integrity of the reinforced concrete product.

SUMMARY OF THE INVENTION

An object of the present invention is to provide a reinforcement spacer for concrete structures which overcomes the aforementioned disadvantages of prior art reinforcement spacers.

Another object of the present invention is to provide a reinforcement spacer which is formed as a single, one-piece structure from non-ferrous material.

A further object of the present invention is to provide a reinforcement spacer that attaches to a welded wire intersection of two reinforcement wires and that can be attached by a worker using only one hand.

Yet another object of the present invention is to provide a reinforcement spacer that can be attached to various types of reinforcement structures that have generally perpendicular welded intersections including lattices of intersecting wires or rebars, welded wire fabrics and cages including helical and circular cages.

Another object of the present invention is to provide a reinforcement spacer that requires only one welded intersection of wires for installation and that can be used with wires of various sizes.

A still further object of the present invention is to provide reinforcement spacers of different sizes and of different colors so that the different-sized spacers can be visually distinguished from one another based on their color.

The foregoing and other objects of the present invention are realized by a reinforcement spacer comprised of a base member having a generally planar shape and having on one side two continuous grooves that extend completely across the base member and that intersect one another for receiving two welded intersecting reinforcement wires and having on the other side a projection that projects outwardly a preselected distance to space the intersecting reinforcement wires a specified distance from a form, and a cover member for covering the intersecting reinforcement wires and that has fastening portions that connect with complementary fastening portions on the base member to fasten the cover member to the base member with the intersecting reinforcement wires clamped therebetween. The fastening portions of the cover member may comprise protrusions each having ratchet teeth along the length thereof, and the complementary fastening portions of the base member may comprise openings each having a pawl that engages with the ratchet teeth of the protrusions when the protrusions are inserted into the openings to thereby fasten the cover member to the base member.

The cover member may be attached to the base member by a hinge member. Preferably, the base member, cover member and hinge member comprise a one-piece structure molded from non-ferrous material, such as plastic.

The cover member preferably has two ridges that are parallel to and extend partly into the two intersecting grooves when the cover member is fastened to the base member to thereby wedge the intersecting reinforcement wires into the intersecting grooves. The cover member may have one or more weakened regions that impart flexibility thereto to allow the cover member to flex slightly about the intersecting reinforcement wires when the cover member is fastened to the base member.

The cover member may also have a projection that projects outwardly a preselected distance to space the intersecting reinforcement wires clamped between the cover and base members from a form in which concrete is to be poured. By providing projections on both the cover and base members, the reinforcement spacer allows the intersecting reinforcement wires to be spaced a specified distance from both outside and inside forms.

The reinforcement spacer may be manufactured with projections of different lengths to accommodate different spacing distances between the welded wire reinforcement and the form. To enable the spacers of different sizes to be readily visually distinguished from one another, the spacers of each different size which have projections of different lengths are color coded. The color coding may consist of forming the reinforcement spacers of different sizes in different colors.

Additional objects, advantages and features of the present invention will be set forth in part in the description which follows, and in part will become apparent to those skilled in the art upon examination of the following description or may be learned by practice of the present invention.

DETAILED DESCRIPTION OF THE INVENTION

For the purposes of illustration, representative embodiments of the present invention are described hereinbelow in the context of the manufacture of precast reinforced concrete products. It will be understood, however, that the present invention is not limited to that particular use, but has general application to the positioning of welded wire reinforcement in concrete or other cast structures. As used herein, unless otherwise stated, the term "welded wire reinforcement" means and includes reinforcement structures made of reinforcement wire or rebar having generally perpendicular welded intersections and includes, without limitation, lattices of intersecting wires or rebars, welded wire fabrics and cages including helical (spiral) and circular cages.

One embodiment of a reinforcement spacer 10 constructed in accordance with the principles of the present invention is shown in FIGS. 1-9. The spacer 10 is preferably formed as a unitary, one-piece structure comprised of a base member 20 and a cover member 30 connected together by a hinge member 40. The spacer 10 is formed of non-ferrous material, such as styrene plastic or other suitable plastic or material, and can economically be manufactured in large quantities by molding from plastic. Though the spacer 10 is designed to be used in small- to medium-size reinforced concrete pipe and other precast products, other materials and various size adjustments may be made to suit additional strength requirements and attachment flexibility for any given application.

Figure 1:
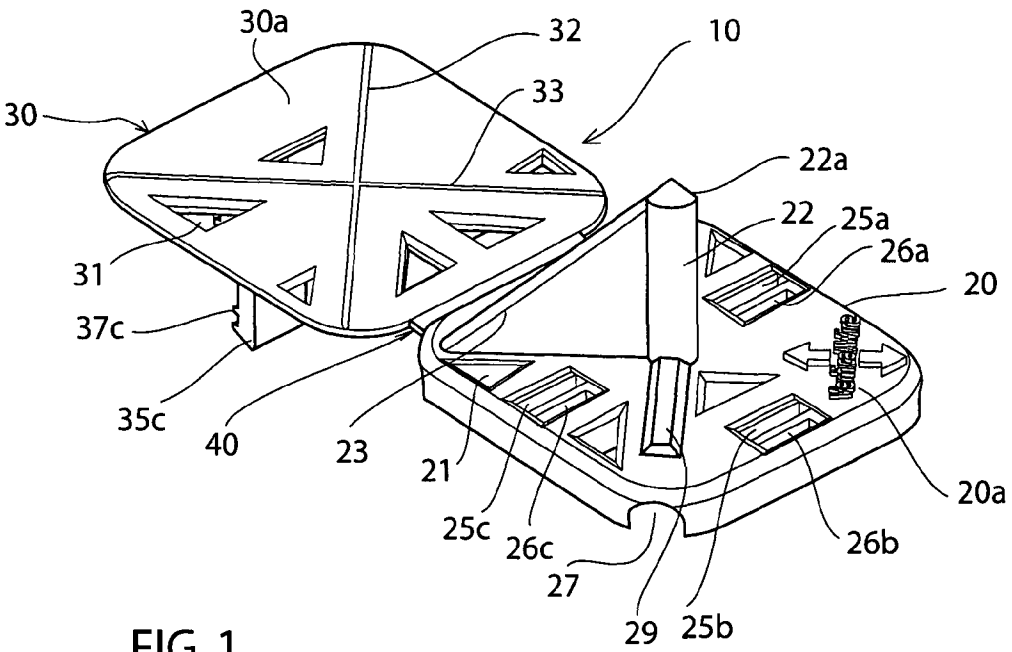
FIG. 1 is a front angled perspective view of a spacer of one embodiment of the present invention shown in the open position.
Figure 2:
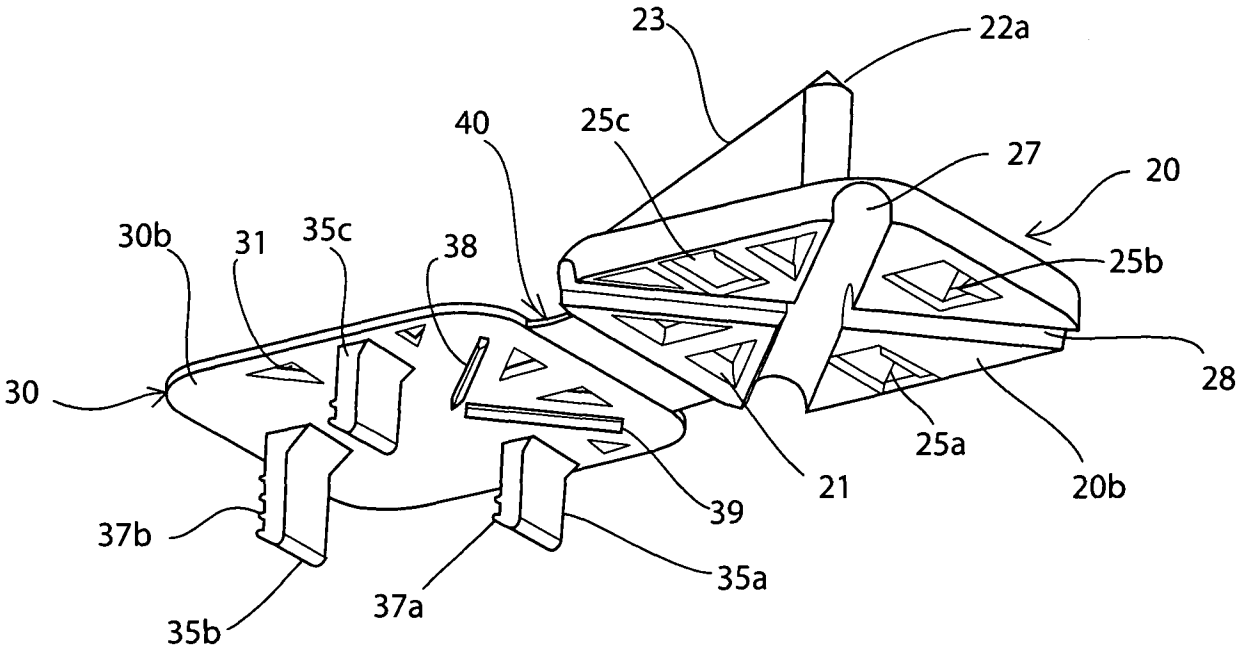
FIG. 2 is a rear angled perspective view of the spacer in the open position.
Figure 3:
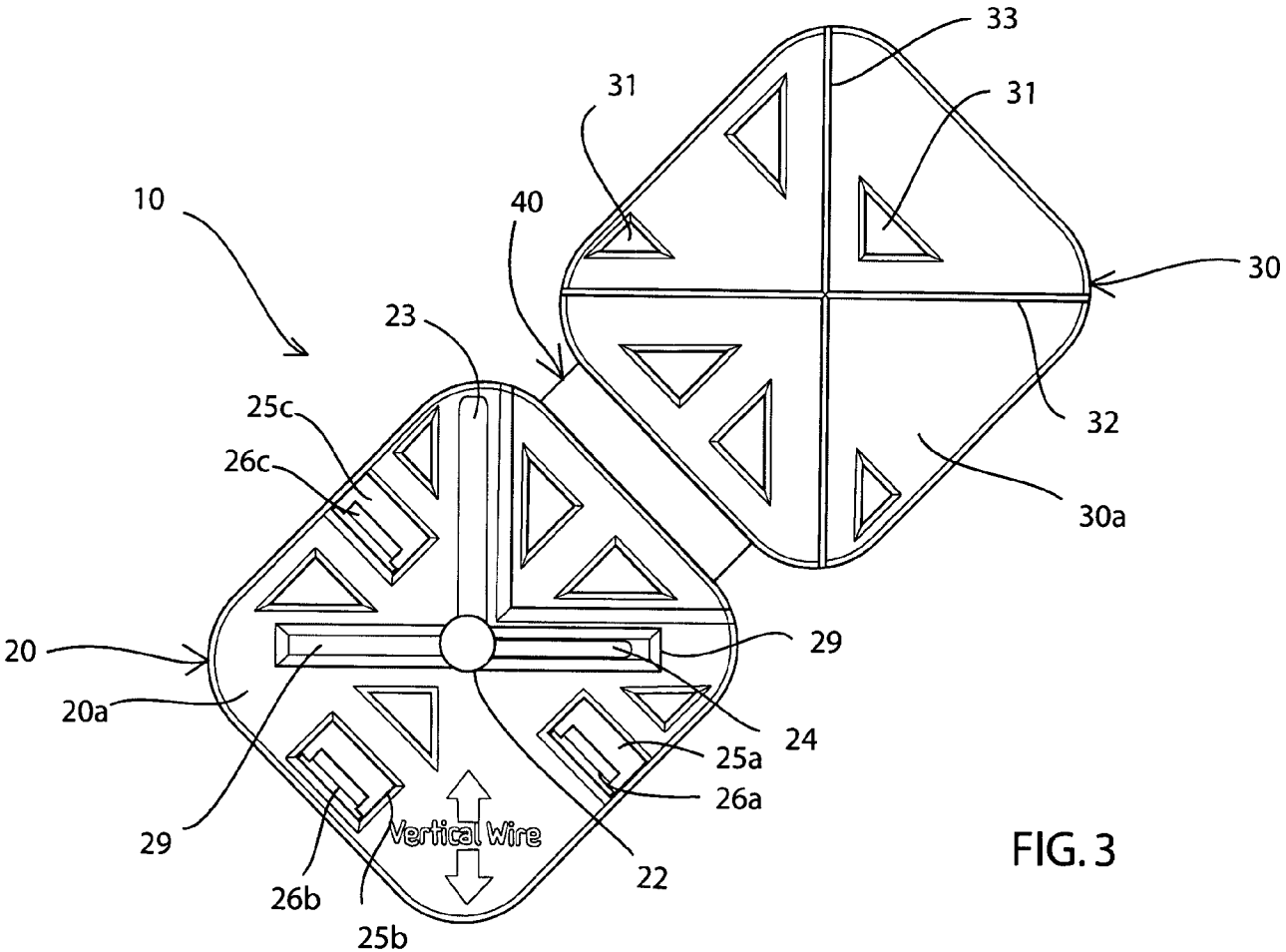
FIG. 3 is a front view of the spacer shown in the open position.
Figure 4:
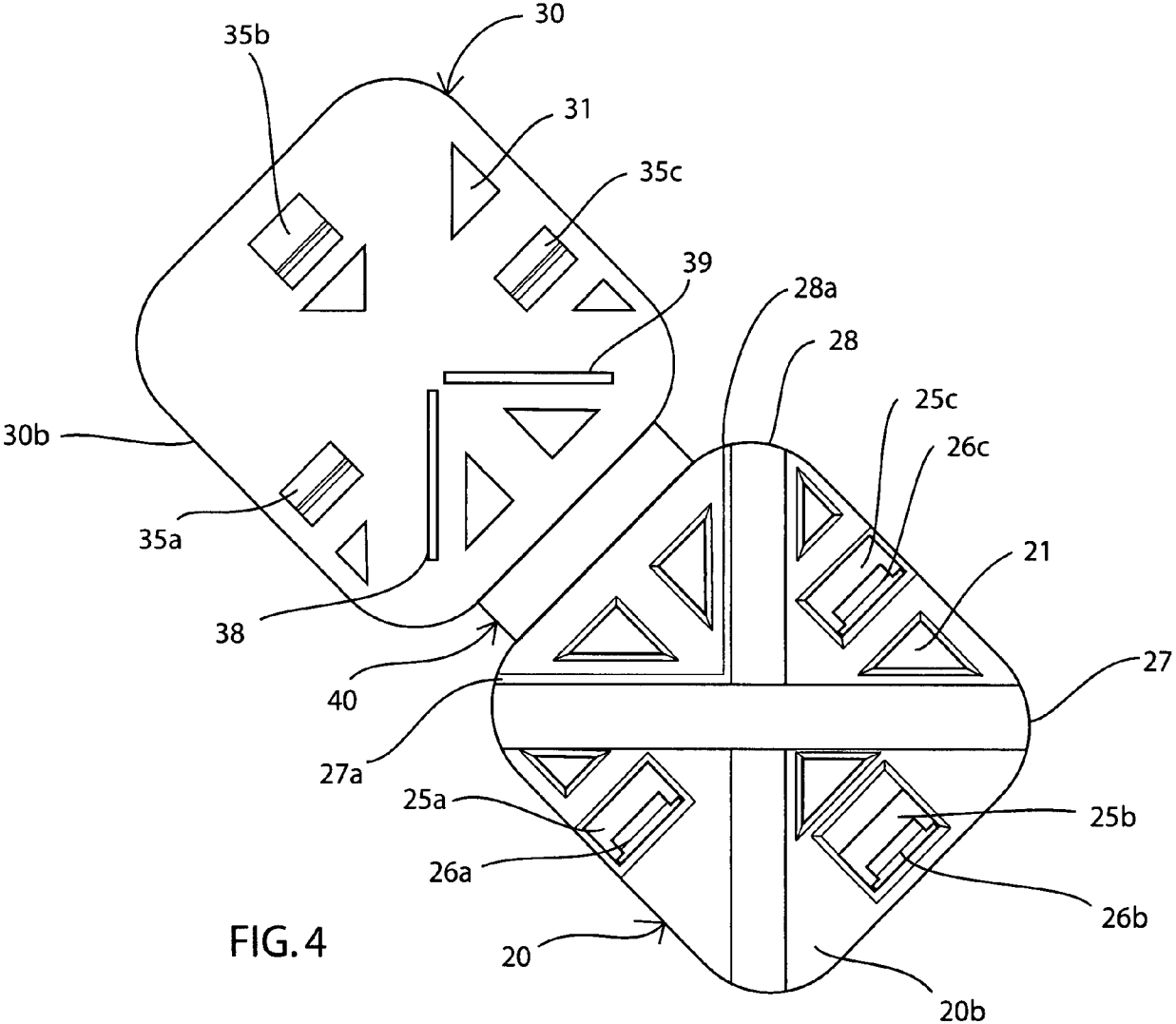
FIG. 4 is a rear view of the spacer shown in the open position.
Figure 5:
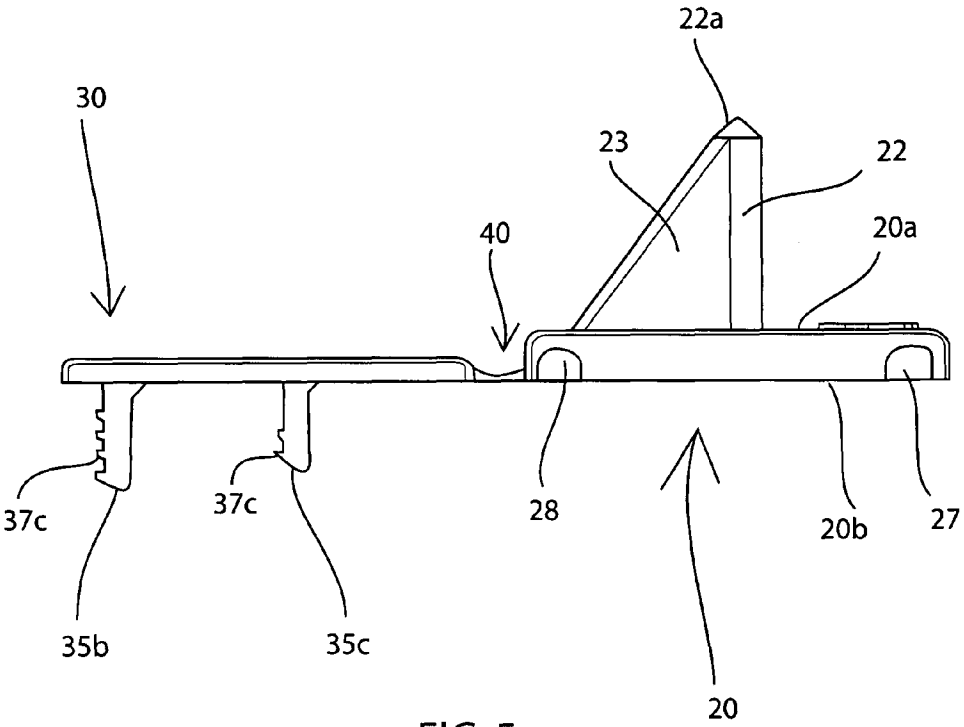
FIG. 5 is a side view of the spacer shown in the open position.
Figure 6:
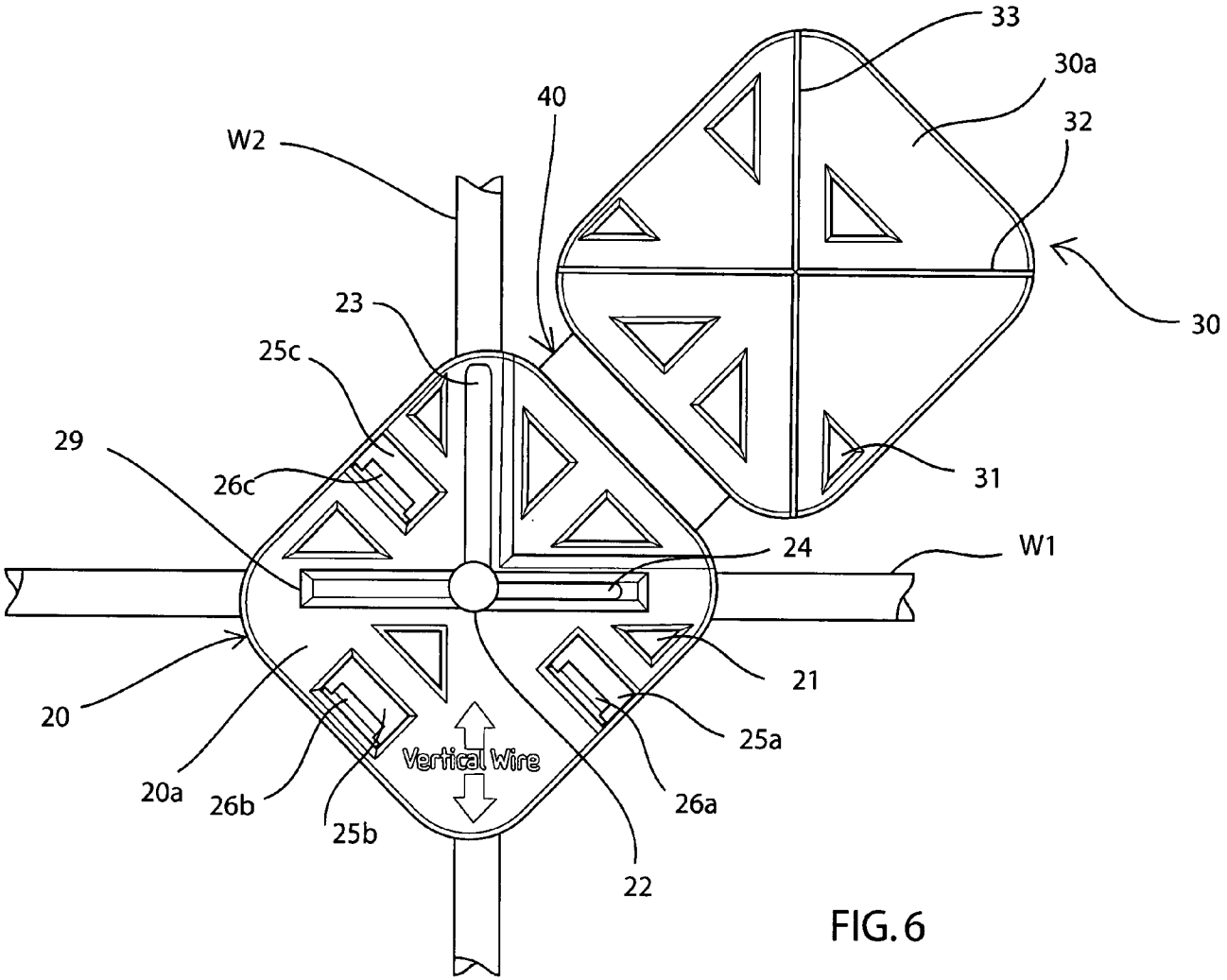
FIG. 6 is a front view of the spacer shown in the open position seated on a welded wire intersection.
Figure 7:
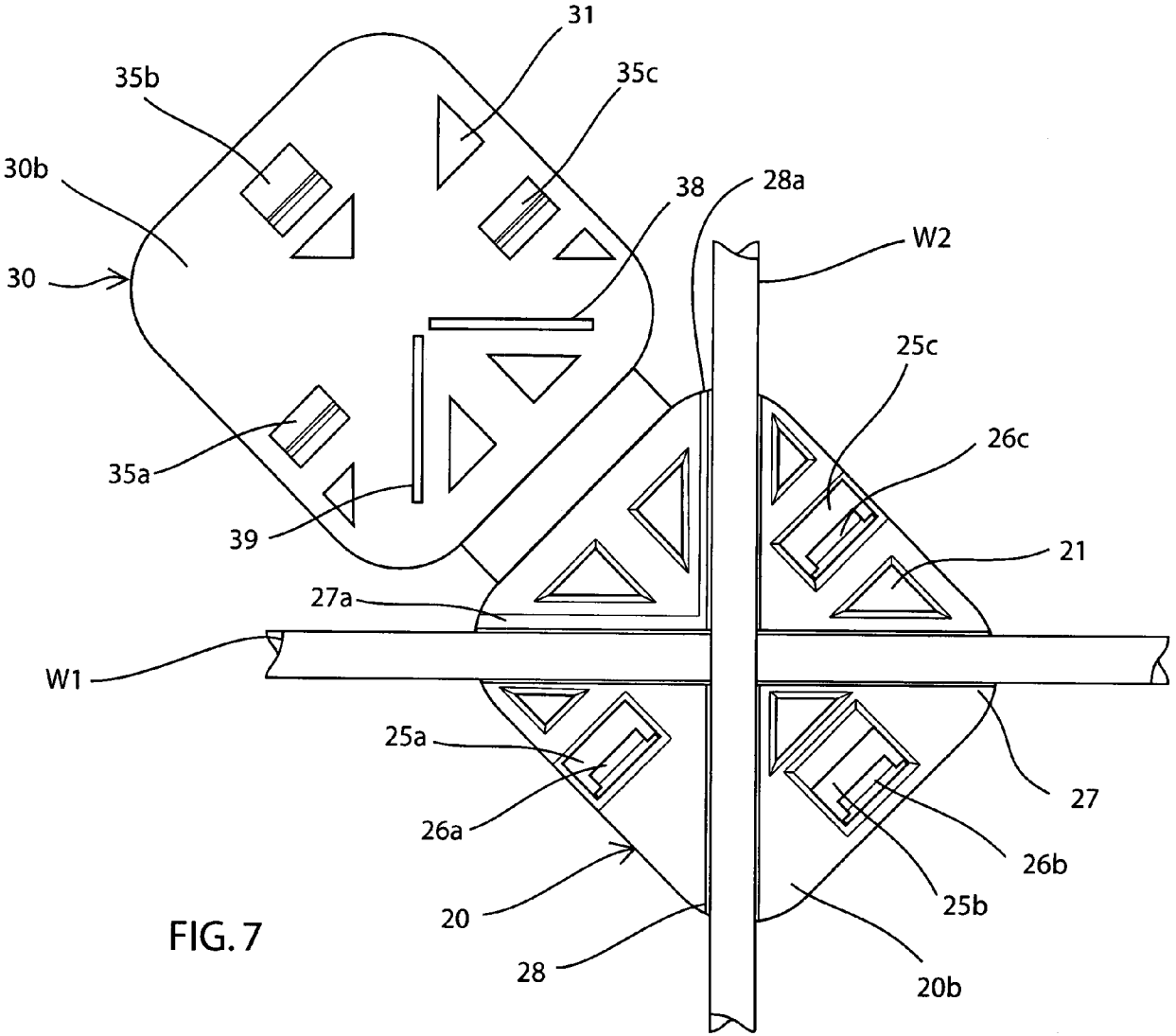
FIG. 7 is a rear view of the spacer shown in the open position seated on a welded wire intersection.
Figure 8:
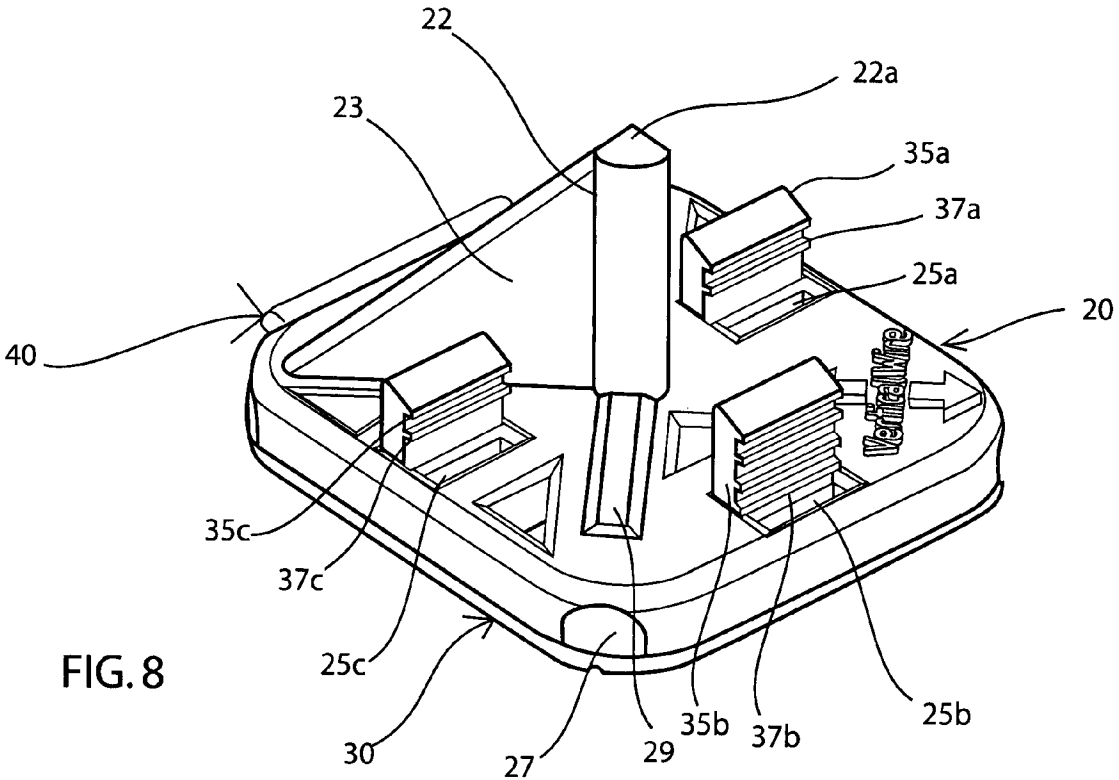
FIG. 8 is a front angled perspective view of the spacer shown in the closed position.
Figure 9:
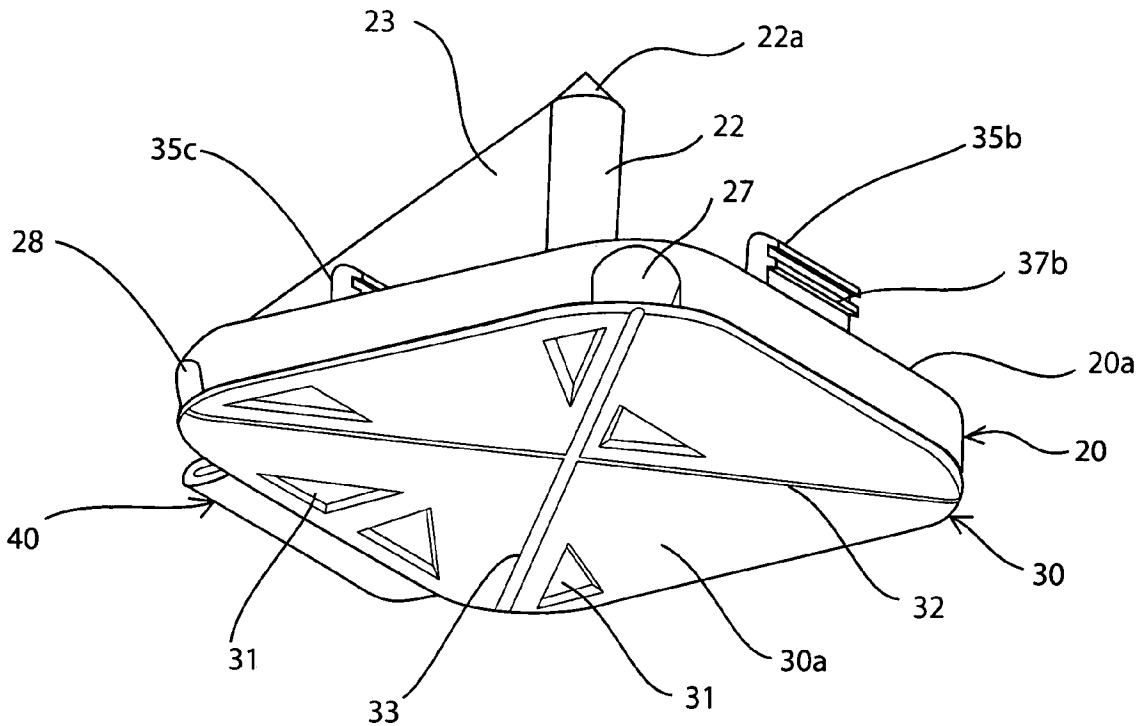
FIG. 9 is a rear angled perspective view of the spacer shown in the closed position.
Figure 10:
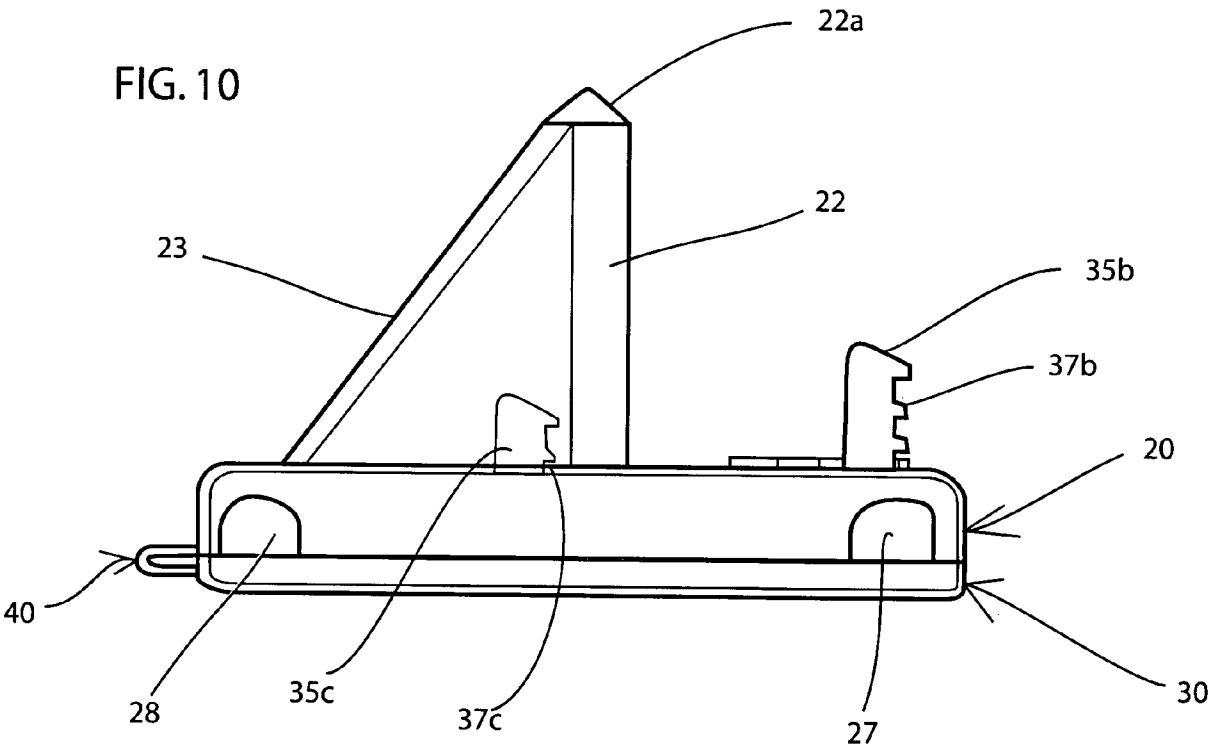
FIG. 10 is a side view of the spacer shown in the closed position.

The spacer 10 is shown in its fully open position (open state) in FIGS. 1-7 and shown in its closed position (closed state) in FIGS. 8-10. For purposes of description, the following nomenclature is used. The "front" or "outer" sides of the base member 20 and the cover member 30 refer to the sides that are exposed and face outwardly when the spacer is in the closed position, and the "rear" or "inner" sides of the base member and the cover member refer to the sides that confront and overlie one another when the spacer is in the closed position. FIGS. 1, 3, 6, 8 and 9 illustrate the front or outer sides of the base member 20 and the cover member 30, and FIGS. 2, 4 and 7 illustrate the rear or inner sides of the base member and the cover member. The front and rear sides of the base member 20 are opposite one another and constitute two opposite sides. Similarly, the front and rear sides of the cover member 30 are opposite one another and constitute two opposite sides.

As illustrated in FIGS. 1, 3, 5, 6, 8 and 9, the base member 20 has a generally planar shape and the front side 20*a* of the base member 20 has a projection 22 that projects outwardly from approximately the center of the base member 20 and terminates at a distal end tip 22*a*. Two triangular sections, a larger one 23 and a smaller one 24, project outwardly from the front side 20*a* of the base member 20 and are connected to the projection 22. The triangular sections 23,24 form a vee at an approximate 90° angle with one another and help brace and support the projection 22. The projection 22 projects outwardly a preselected distance to space a pair of intersecting reinforcement wires clamped between the cover and base members a specified distance from a form in which concrete is to be poured.

The base member 20 is provided with through-openings 25 each of which contains a fixed pawl 26. In this embodiment there are three openings 25*a*,25*b*,25*c* which contain fixed pawls 26*a*,26*b*,26*c*, and it is understood that a greater or lesser number of openings and fixed pawls can be utilized depending on the size and configuration of the spacer. As described hereinafter, the fixed pawls 26 coact with ratchet protrusions that are provided on the rear side 30*b* of the cover member 30 and that extend into the openings 25 when the spacer is in the closed position.

The rear side 20*b* of the base member 20 is provided with two continuous grooves 27 and 28 that extend completely across the base member and that intersect one another, as shown in FIGS. 2 and 4. The rear side 20*b* preferably has a planar surface, and the grooves 27,28 are formed in the planar surface perpendicular to each other and extend from edge to edge of the base member 20. The grooves 27,28 are preferably semicylindrical in shape to receive therein a pair of intersecting reinforcement wires W1 and W2, as illustrated in FIG. 7. The reinforcement wires are welded together at their point of intersection prior to attachment of the spacer 10. For purposes of description, the spacer 10 will be described with reference to a circular reinforcement cage made of reinforcement wires having perpendicular welded intersections as exemplified by the reinforcement wires W1,W2 shown in FIGS. 6 and 7.

The depth of the groove 27, which receives a main horizontal (circumferential) reinforcement wire W1 in a circular reinforcement cage, varies gradually from end to end in a slight arc so that the depth of the center of the groove 27 is greater than the depth at its ends. The depth of the vertical groove 28, which receives a vertical (transverse) wire W2 in a circular reinforcement cage, is the same from end to end and is shallower than the depth of the groove 27. This allows the two semicircular grooves 27 and 28 to seat firmly on the intersecting reinforcement wires W1 and W2 as illustrated in FIGS. 6 and 7. Due to the deeper depth of the groove 27, the thickness of the base member 20 in the region of the groove 27 is substantially reduced and therefore weakened. To compensate for this reduction in thickness, a strengthening ridge 29 is provided on the front side 20*a* of the base member 20 and extends lengthwise over the region of the groove 27, as shown in FIGS. 1, 3 and 8. The strengthening ridge 29 effectively increases the thickness of the base member 20 in the region where the groove 27 is formed, and the ridge can easily be formed when the spacer is molded from plastic.

The cover member 30, as illustrated in FIGS. 1, 3, 6 and 9, has two perpendicular grooves 32 and 33 formed in the front side 30*a* thereof. The grooves 32,33 extend from edge to edge of the cover member and constitute weakened regions that permit slight flexure of the cover member. By such a construction, when the cover member 30 moves to the closed position and the rear side 30*b* thereof engages with the reinforcement wires W1,W2, the cover member can flex slightly to fit around the portions of the reinforcement wires which protrude slightly above the grooves 27,28. As illustrated in FIGS. 2, 5 and 8, the rear side 30*b* of the cover member 30 is provided with linear ratchet protrusions 35 that extend outwardly and perpendicularly to the cover member, and each of the linear ratchet protrusions 35 is provided with a set of inclined teeth 37. In this embodiment, there are three linear ratchet protrusions 35*a*,35*b*,35*c* that have inclined teeth 37*a*, 37*b*,37*c* located on one side of the ratchet protrusions, and the number of linear ratchet protrusions 35 is the same as the number of fixed pawls 26 on the base member 20. When the cover member 30 is moved to the closed position, the ratchet protrusions 35 are inserted into the openings 25 of the base member 20 and when in the fully closed position, the inclined teeth 37 of the ratchet protrusions 35 engage with the fixed pawls 26 provided in the openings 25 of the base member 20 to fasten and lock together the cover and base members.

In this embodiment, the openings 25 and the fixed pawls 26 on the base member 20 constitute first fastening portions, and the ratchet protrusions 35 with the inclined teeth 37 constitute second fastening portions. The first fastening portions coact with the complementary second fastening portions to fasten the cover member to the base member. Alternatively, the openings 25 with the fixed pawls 26 could be formed on the cover member 30 and the ratchet protrusions 35 with the inclined teeth 37 could be formed on the base member 20. The present invention is not, of course, limited to this type fastener and any other suitable fastener can be used. For example, a snap-fit fastener or a friction-fit fastener could be used, in which protrusions are provided on one of the base and cover members and complementary openings are provided on the other of the base and cover members for receiving the protrusions.

As illustrated in FIGS. 2, 4 and 7, linear ridges 38 and 39 are provided on the rear side 30*b* of the cover member 30. The ridges 38,39 protrude slightly from the cover member 30 and are situated approximately 90° with respect to each other. The ridges 38,39 are positioned so that they are parallel to and extend partly into the two intersecting grooves 27,28 when the cover member 30 is fastened to the base member 20 and function to wedge the intersecting reinforcement wires W1,W2 into the intersecting grooves 27,28. The upper edges of the grooves 27,28 have slightly tapered edge portions 27*a*, 28*a* (FIGS. 4 and 7) in the regions where the ridges 38,39 extend into the grooves. Provision of the tapered edge portions 27*a*,28*a* assists the wedging action of the ridges 38,39 between the reinforcement wires and the grooves in cases where the diameters of the reinforcement wires are less than the diameters of the semicylindrical grooves 27, 28.

The manner of installing the spacer 10 and attaching it to the intersecting reinforcement wires W1,W2 is illustrated in FIGS. 6 and 7. A worker, using one hand, first mounts the base member 20 onto the welded wire intersection of the reinforcement wires W1,W2 so that the grooves 27,28 on the rear side 20*b* of the base member 20 come in contact with and seat on the respective wires W1,W2. On the front side 20*a* of the base member 20 are two oppositely extending arrows with the words "VERTICAL WIRE" located between the arrows as illustrated in FIG. 6. The purpose of this wording is to aid the worker to properly align the base member 20 with the vertical wire W2. As illustrated in FIG. 6, the worker uses his thumb to maintain the base member 20 pressed against the welded wire intersection and then uses his fingers to pivot the cover member 30 at the hinge member 40 to position the rear side of the cover member 30 over the rear side of the base member 20 with the welded wire intersection clamped therebetween.

During pivotal movement of the cover member 30 toward the base member 20, the linear ratchet protrusions 35*a*,35*b*, 35*c* on the cover member 30 are inserted into the openings 25*a*,25*b*,25*c* in the base member 20, and the inclined teeth 37*a*,37*b*,37*c* that are located on one side of the linear ratchet protrusions come in contact with the fixed pawls 26*a*,26*b*,26*c* provided in the openings 25*a*,25*b*,25*c*. Due to the fact that the inclined teeth 37*a*,37*b*,37*c* are inclined in a direction opposite to the insertion direction of the ratchet protrusions into the openings, the inclined teeth proceed past the fixed pawls 26*a*,26*b*,26*c* until the cover member 30 engages with the exposed portions of the intersecting wires W1,W2 that project above the grooves 27,28. The fixed pawls 26*a*,26*b*,26*c* allow insertion of the ratchet protrusions into the openings and when the spacer is in the fully closed position, the fixed pawls engage with respective ones of the inclined teeth 37*a*, 37*b*,37*c* to prevent withdrawal of the ratchet protrusions from the openings. FIGS. 8, 9 and 10 illustrate the spacer 10 in the fully closed position.

When the spacer 10 is in the fully closed position, the rear side 30*b* of the cover member 30 engages with the protruding portions of the wires W1,W2 at the welded wire intersection. The grooves 32,33 provided on the front side 30*a* of the cover member 30 constitute weakened regions that allow the cover member to slightly flex around the protruding portions of the welded wire intersection to thereby more securely clamp the welded wire intersection between the cover and base members. When the spacer 10 is in the fully closed position, the ridges 38,39 on the rear side 30*b* of the cover member 30 are parallel to and extend partly into the semicylindrical intersecting grooves 27,28, thereby wedging the reinforcement wires more securely into the semicylindrical grooves, especially when the wire diameters are less than the diameters of the semicylindrical grooves.

After attachment of the spacer 10 to the welded wire intersection of the wires W1,W2, the projection 22 projects outwardly a preselected distance that corresponds to the distance that the welded wire reinforcement clamped between the base and cover members is to be spaced from a form in which concrete is to be poured. The distal end tip 22*a* of the projection 22 is conical, or may be rounded, to reduce the contact area between the spacer, i.e., the projection, and the form.

The base member 20 and the cover member 30 are provided with numerous voids 21 and 31 in order to reduce the quantity of material used to manufacture the spacer. The voids do not affect the strength, function or operation of the spacer 10 but do reduce the weight and manufacturing costs of the spacer.

In the illustrated embodiment, the base member 20 and the cover member 30 are interconnected by the hinge member 40. Provision of the hinge member 40 prevents inadvertent separation of the base and cover members prior to installation of the spacer and enables a worker to install the spacer at a welded wire intersection using only one hand. If desired, the hinge member 40 could be eliminated and some other means employed to pair the base and cover members together.

Figure 11:
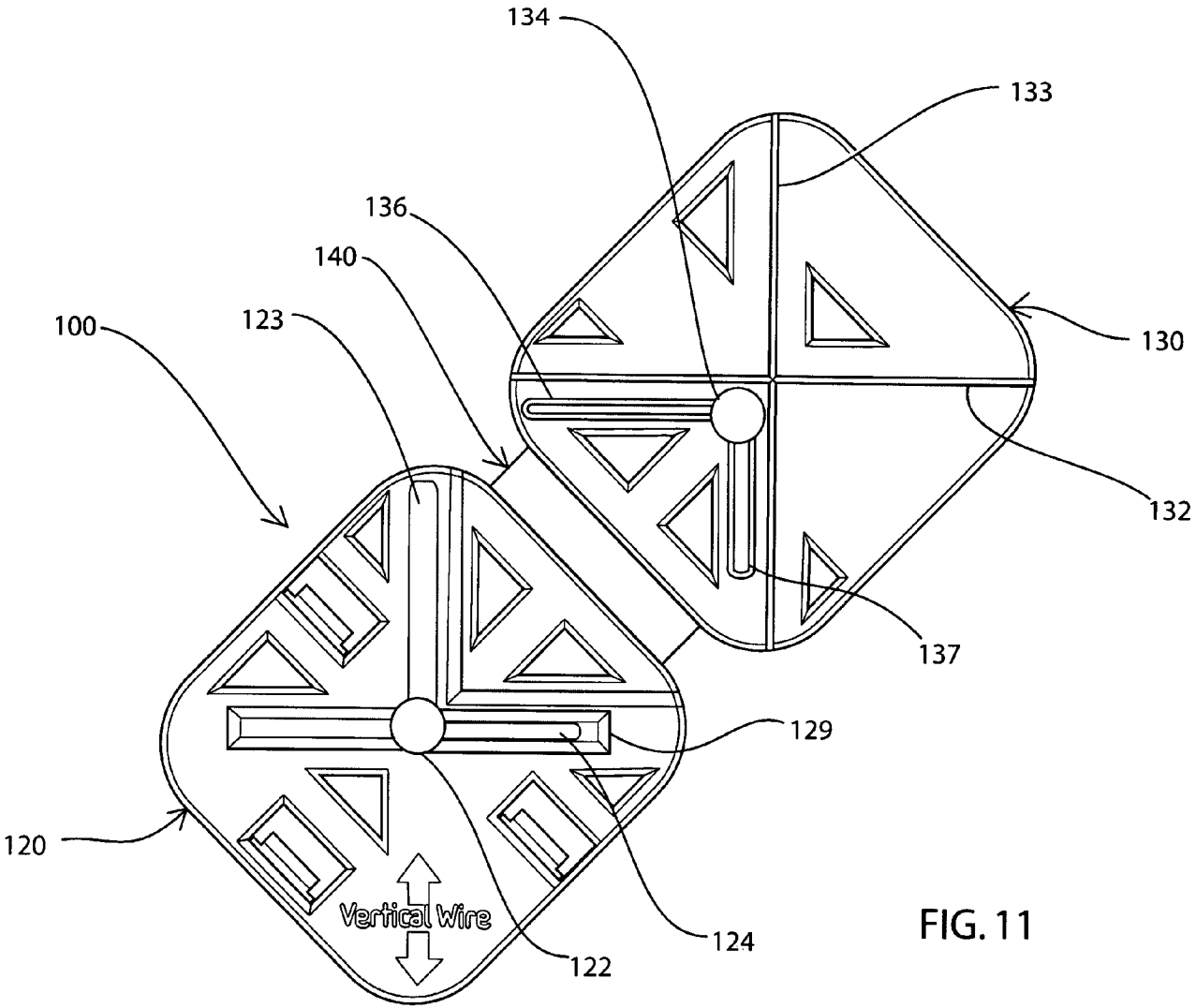
FIG. 11 is a front view of a spacer of a second embodiment of the present invention shown in the open position.
Figure 12:
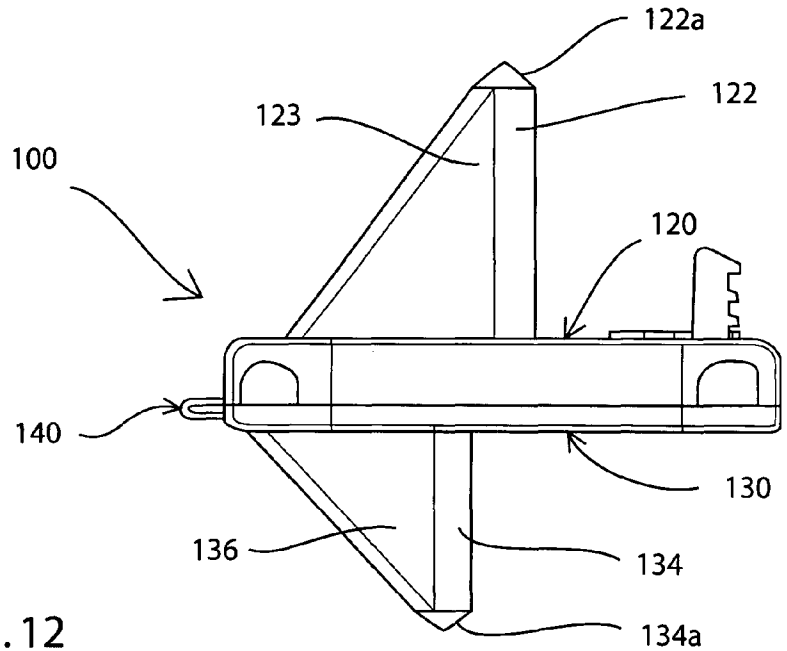
FIG. 12 is a side view of the spacer of the second embodiment shown in the closed position.

Another embodiment of a reinforcement spacer 100 constructed in accordance with the principles of the present invention is illustrated in FIGS. 11-12. The spacer 100 is similar to the spacer 10 of the first embodiment except for the cover member. The spacer 100 comprises a base member 120 and a cover member 130 connected together by a hinge member 140. The base member 120 and the hinge member 140 have the same construction as the base member 20 and the hinge member 40 of the spacer 10. The cover member 130 of the spacer 100 differs from the cover member 30 of the spacer 10 in that the cover member 130 includes a projection 134 that projects outwardly from approximately the center of the cover member 130 and terminates at a distal end tip 134*a*. Two triangular sections, a larger one 136 and a smaller one 137, project outwardly from the front side of the cover member 130 and are connected to the projection 134. The triangular sections 136,137 form a vee at an approximate 90° angle with one another and are provided to brace and support the projection 134. The rear side of the cover member 130 is the same as that of the cover member 30 of the spacer 10.

The projection 134 projects outwardly a preselected distance that corresponds to the distance which the welded wire reinforcement clamped between the base and cover members is to be spaced from a form in which concrete is to be poured. FIG. 12 illustrates the spacer 100 in the fully closed position. The spacer 100 allows the welded wire reinforcement to which the spacer is fastened to be spaced a specified distance from both outside and inside forms. The distance from the welded wire reinforcement to both the outside and inside forms may or may not be the same and is determined by the length of the projections 122 and 134. In the example illustrated in FIG. 12, the length of the projection 122 of the base member 120 is greater than the length of the projection 134 of the cover member 130.

Figure 13:
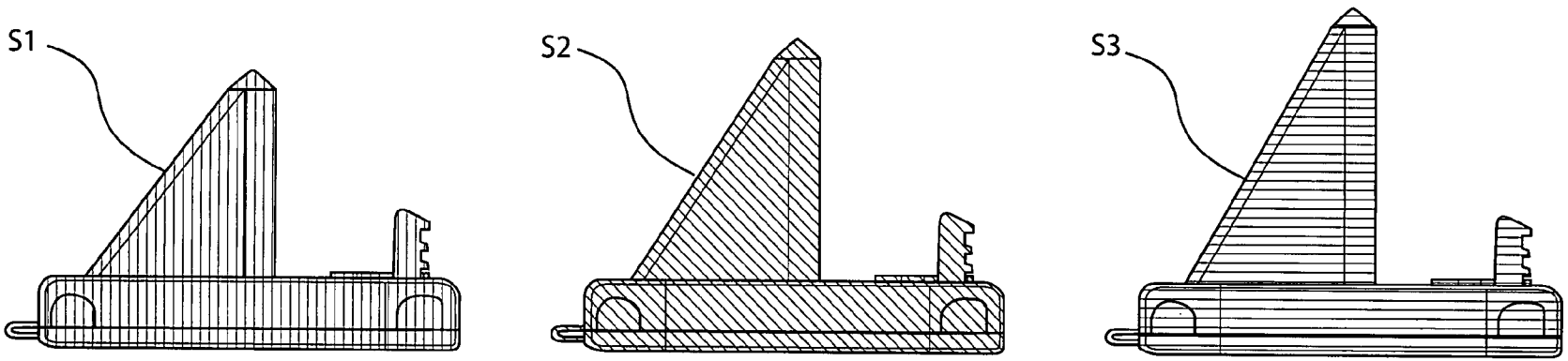
FIG. 13 is a side view of spacers of different sizes and different colors according to the present invention.

In the manufacture of reinforced concrete structures, it is important that the welded wire reinforcement be properly positioned within the body of a form prior to the introduction of concrete. The distance between the welded wire reinforcement and the form varies depending on the nature and size of the reinforced concrete structure and, therefore, it is necessary to provide spacers of different sizes to accommodate these different spacing distances. In accordance with another aspect of the present invention, spacers having projections of different lengths are provided for positioning intersecting reinforcement wires at different distances from the surface of a form. To enable the spacers of different sizes to be readily visually distinguished from one another, the spacers of each different size, i.e., having projections of different lengths, are color coded. For example, as illustrated in FIG. 13, a spacer S1 having a projection of a first length has a red color, a spacer S2 having a projection of a different length has a green color, and a spacer S3 having a projection of another different length has a blue color. This enables a worker to easily visually distinguish between the different size spacers based solely on their color. When the spacers are molded from plastic, plastic of different colors can be used to mold spacers of different sizes. Other color coding techniques could be used, such as adhering differently colored tabs or labels to spacers of different sizes.

It will be appreciated by those skilled in the art that obvious changes can be made to the embodiments described in the foregoing description without departing from the broad inventive concept thereof. It is understood, therefore, that the present invention is not limited to the particular embodiments disclosed, but is intended to cover all obvious modifications thereof which are within the scope and spirit of the invention as defined by the appended claims.

What is claimed is:

1. A spacer for attachment to a pair of intersecting reinforcement wires to space them from a form, the spacer comprising:

a base member having a generally planar shape and two opposite sides, one of the sides having two continuous grooves that extend completely across the base member and that intersect one another for receiving therein a pair of intersecting reinforcement wires, and the other of the sides having a projection that projects outwardly therefrom a preselected distance to space the intersecting reinforcement wires a specified distance from a form; and a cover member for covering the one side of the base member, the cover member having fastening portions that coact with complementary fastening portions on the base member to fasten the cover member to the base member with the intersecting reinforcement wires sandwiched therebetween to thereby attach the spacer to the intersecting reinforcement wires.

2. A spacer according to claim 1; further including a hinge member that connects the cover member to the base member.

3. A spacer according to claim 2; wherein the base member, cover member and hinge member comprise a one-piece structure.

4. A spacer according to claim 3; wherein the one-piece structure comprises a molded non-ferrous structure.

5. A spacer according to claim 1; wherein the two grooves each have a generally semicylindrical shape.

6. A spacer according to claim 5; wherein one of the two grooves is larger in cross section than the other.

7. A spacer according to claim 6; wherein the depth of the larger groove varies from end to end in an arc so that the depth at the center of the groove is greater than the depth at the ends thereof.

8. A spacer according to claim 7; wherein the depth of the smaller groove is constant from end to end.

9. A spacer according to claim 5; wherein the cover member has two ridges that are parallel to and extend partly into respective ones of the two grooves when the cover member is fastened to the base member to thereby wedge the intersecting reinforcement wires into the intersecting grooves.

10. A spacer according to claim 1; wherein one of the two grooves is larger in cross section than the other.

11. A spacer according to claim 10; wherein the depth of the larger groove varies from end to end in an arc so that the depth at the center of the groove is greater than the depth at the ends thereof.

12. A spacer according to claim 11; wherein the depth of the smaller groove is constant from end to end.

13. A spacer according to claim 1; wherein the cover member has two ridges that are parallel to and extend partly into respective ones of the two grooves when the cover member is fastened to the base member to thereby wedge the intersecting reinforcement wires into the intersecting grooves.

14. A spacer according to claim 1; wherein one of the fastening portions or the complementary fastening portions comprises openings, and the other of the fastening portions or the complementary fastening portions comprises protrusions that are insertable into respective ones of the openings and engageable therewith to fasten the cover member to the base member.

15. A spacer according to claim 14; wherein the protrusions each have ratchet teeth spaced along the length thereof, and the openings each have a pawl engageable with one of the ratchet teeth of a respective protrusions to fasten the cover member to the base member.

16. A spacer according to claim 15; wherein the ratchet teeth are inclined in a direction opposite to the direction of insertion of the protrusions into the openings so that the ratchet teeth can slide over the pawls during insertion of the protrusions into the openings but the protrusions cannot thereafter be withdrawn from the openings due to engagement of the ratchet teeth with the pawls.

17. A spacer according to claim 1; wherein the cover member has one or more weakened regions that impart flexibility thereto to allow the cover member to flex slightly about the intersecting reinforcement wires when the cover member is fastened to the base member.

18. A spacer according to claim 1; further including two triangular sections that project outwardly from the other side of the base member and that are connected to the projection to brace the projection.

19. A spacer according to claim 1; wherein the cover member has two opposite sides, one of the sides overlying and covering the one side of the base member when the cover member is fastened to the base member and the other of the sides having a projection that projects outwardly therefrom a preselected distance to space the intersecting reinforcement wires a specified distance from another form, and wherein the projection of the cover member and the projection of the base member project outwardly in opposite directions.

20. A plurality of spacers each according to claim 1; the plurality of spacers being divided into plural groups with the spacers in each group having projections of the same length and the spacers in different groups having projections of different lengths, and the spacers in each group being color coded differently from the spacers in the other groups so that spacers having projections of different lengths can be visually distinguished from one another based on the color coding.

21. A plurality of spacers according to claim 20; wherein the plurality of spacers are made of colored plastic with the spacers in each group being of a different color.

22. A spacer according to claim 1; wherein the one side of the base member has a planar surface in which are formed the two grooves.

* * * * *